United States Patent [19]

Christianson

[11] 4,076,041

[45] Feb. 28, 1978

[54] PILOT VALVE OPERATED DEMAND REGULATOR FOR A BREATHING APPARATUS

[76] Inventor: Raymond A. Christianson, 120 8th St., Manhattan Beach, Calif. 90266

[21] Appl. No.: 587,272

[22] Filed: Jun. 16, 1975

Related U.S. Application Data

[63] Continuation-in-part of Ser. No. 508,580, Sept. 23, 1974, abandoned.

[51] Int. Cl.[2] ..... F16K 31/126

[52] U.S. Cl. ..... 137/490; 137/489.5; 137/492.5

[58] Field of Search ..... 137/489.5, 485, 488, 137/484.2, 484.6, 484.8, 63 R, 490, 492, 492.5

[56] References Cited

U.S. PATENT DOCUMENTS

| | | | |
|---|---|---|---|
| 757,590 | 4/1904 | Zindol | 137/489.5 |
| 1,184,761 | 5/1916 | Lytton | 137/489.5 |
| 1,198,595 | 9/1916 | Stolle | 137/63 R |
| 2,817,334 | 12/1957 | Sajeck | 137/63 R |
| 3,047,001 | 7/1962 | Hosford | 137/490 X |
| 3,381,707 | 5/1968 | Andersen | 137/489.5 |
| 3,495,619 | 2/1970 | Iizumi | 137/489.5 |
| 3,783,891 | 1/1974 | Christianson | 137/491 |

*Primary Examiner*—Alan Cohan

*Attorney, Agent, or Firm*—Spensley, Horn & Lubitz

[57] ABSTRACT

A scuba regulator second stage utilizes pneumatic amplification to achieve very low inhalation effort. The regulator includes (a) a main flow valve consisting of a poppet moveable within a valve housing inside the regulator body, (b) a pilot valve mounted within and carried by the main valve poppet, and (c) a pressure sensing diaphragm linked to the pilot valve.

During inhalation, the diaphragm and linkage open the pilot valve to admit gas at supply pressure into a space, between the poppet and a closed end of the housing. This gas displaces the poppet, thereby opening the main flow valve and supplying gas to the diver. Pneumatic amplification is achieved. The poppet displacement tends to close the pilot valve, so that the poppet-opening force is reduced. This feedback effect results in substantially linear relationship between inhalation demand and the amount of breathable gas supplied to the diver.

8 Claims, 10 Drawing Figures

PILOT VALVE OPERATED DEMAND REGULATOR FOR A BREATHING APPARATUS

RELATED APPLICATIONS

The present application is a continuation-in-part of application Ser. No. 508,580, filed Sept. 23, 1974 now abandoned.

BACKGROUND OF THE INVENTION

1. Field of the Invention

The present invention relates to a pilot valve operated demand regulator for an underwater breathing apparatus, and more particularly to such a regulator using pneumatic amplification and feedback to achieve very low inhalation effort and substantially linear relationship between inhalation effort and supplied breathable gas.

2. Description of the Prior Art

A self contained underwater breathing apparatus (scuba) typically employs a supply tank of air or other breathable gas under high pressure and a two stage regulator to provide this air to the diver. The regulator first stage is mounted at the supply tank and functions to reduce the air pressure to about 140 psi above the ambient pressure. A conduit supplies this reduced pressure air to a regulator second stage at the diver's mouthpiece. The second stage includes a demand valve system which opens to supply breathable gas in response to the inhalation effort of the diver. An exhaust port may be provided to discharge gas exhaled through the mouthpiece.

Ideally the regulator second stage should provide to the diver exactly the volume of air required, without excessive inhalation effort. The problems associated with achieving such performance are discussed in the inventor's U.S. Pat. No. 3,783,891 which discloses a balanced regulator second stage employing pneumatic amplification.

In that patented demand regulator, a balanced primary valve controls the flow of breathable gas from the supply conduit inlet to an outlet chamber leading to the mouthpiece. The primary valve is not controlled directly by a mechanical linkage to the demand-sensing diaphragm. Rather, it is responsive to the pressure differential between the inlet and a control chamber the pressure in which is established by a pilot valve linked to the diaphragm. Thus pneumatic amplification isolates the diaphragm from the flow control valve to achieve sensitive response between inhalation demand and volume of air supplied to the diver.

To achieve this performance, the patented balanced regulator includes a small orifice through the primary valve to bleed some air into the control chamber. The pilot valve includes a pilot orifice in a secondary flow path from the control chamber to the outlet chamber. This pilot orifice is selectively blocked or unblocked by a valve poppet that is linked to the diaphragm. As the diaphragm senses reduced pressure in the outlet chamber, signifying an inhalation demand, the pilot orifice is slightly unblocked to lower the control chamber pressure. The resultant pressure differential between the inlet and the control chamber causes the primary valve to open proportionately, until the unbalanced pressure force exerted on the primary valve is balanced by the bias spring force. Supplied breathable gas flows past the primary valve directly to the outlet chamber and the mouthpiece.

An object of the present invention is to provide a regulator second stage which, though utilizing pneumatic amplification, is of different configuration and simpler construction than known regulators. Another object is to provide a demand regulator which employs both pneumatic amplification and feedback to achieve low inhalation effort and a linear relationship between inhalation demand and the amount of supplied breathable gas. A further object of the present invention is to provide an improved demand regulator in which the flow of breathable gas is controlled by a main flow valve having a moveable poppet, and in which motion of the poppet is imparted pneumatically by the pressure of supplied gas under control of a pilot valve that is moounted within and carried by the moveable poppet. Yet another object is to provide a demand regulator having no pressure control chamber and requiring no bleed passage through the main valve component to a pressure control region.

SUMMARY OF THE INVENTION

These and other objectives are achieved by providing a demand regulator in which a valve housing is supported within the interior chamber of the regulator body. A movable poppet is situated within the housing and biased toward a substantially closed end thereof. Breathable gas is introduced into an annular space defined by the interior wall of the housing and a region of reduced diameter in the poppet. The flow of breathable gas from this annular space to the mouthpiece, via the body interior chamber, is controlled by a flow valve consisting of the annular edge of the housing open end and a sealing ring mounted on an adjacent shoulder on the poppet. This flow valve normally is biased closed.

Mounted within the poppet is a normally closed pilot valve. The control pin of the pilot valve extends through a small opening in the substantially closed end of the valve housing. A diaphragm situated in the body interior chamber is linked to this control pin. Diaphragm displacement in response to inhalation demand moves the pin to open the pilot valve. As a result, gas under pressure is admitted to the space between the poppet and the housing closed end. The force of this admitted gas overcomes the bias and causes the poppet to move away from the housing closed end. This opens the flow valve, permitting breathable gas to be supplied to the mouthpiece. As the inhalation demand is satisfied, the pilot valve closes and the poppet returns to the flow-blocking position. This return is not abrupt, but rather follows the inhalation demand so that the diver receives just the desired amount of breathable gas.

BRIEF DESCRIPTION OF THE DRAWINGS

A detailed description of the invention will be made with reference to the accompanying drawings wherein like numerals designate corresponding parts in the several figures. These drawings, unless described as diagrammatic, or unless otherwise indicated, are to scale.

DESCRIPTION OF THE PREFERRED EMBODIMENTS

The following detailed description is of the best presently contemplated modes of carrying out the invention. This description is not to be taken in a limiting sense, but is made merely for the purpose of illustrating the general principles of the invention since the scope of the invention is best defined by the appended claims.

Structural and operational characteristics attributed to forms of the invention first described also shall be attributed to forms later described, unless such characteristics obviously are inapplicable or unless specific exception is made.

Figure 1:
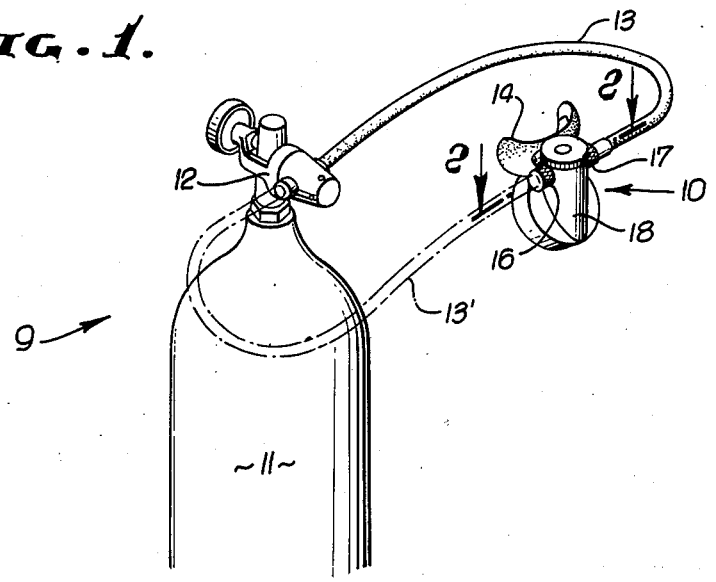
FIG. 1 is a pictorial view of an underwater breathing apparatus incorporating the inventive pilot valve operated regulator second stage.

In FIG. 1 there is shown a self-contained underwater breathing apparatus 9 incorporating the inventive demand regulator 10. The scuba system 9 includes a supply tank 11 containing breathable gas under high pressure. Attached to the tank 11 is a conventional regulator first stage 12 which provides the breathable gas at a reduced pressure, typically 140 psi above ambient, to a conduit 13. The inventive regulator second stage 10 is connected to the other end of the conduit 13 and functions to deliver breathable gas to a diver via a mouthpiece 14 upon inhalation demand. Advantageously the regulator 10 has two inlet ports 15, 15′ so that the diver can use either a conduit 13 over his left shoulder or alternatively a conduit 13′ over his right shoulder. The unused inlet connector 15 or 15′ is closed by a cap 16 as shown in FIG. 2, and the conduit 13 is attached by a connector 17.

Figure 2:
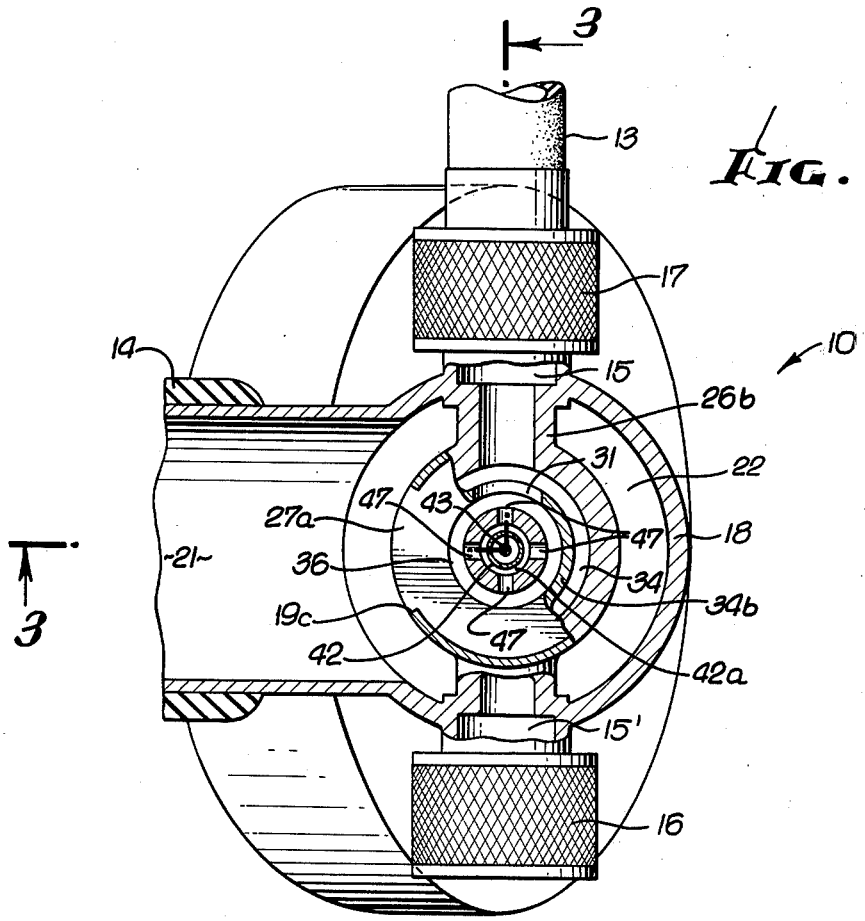
FIG. 2 is a sectional view of the inventive regulator second stage as seen along the line 2—2 indicated in FIGS. 1 and 3.
Figure 3:
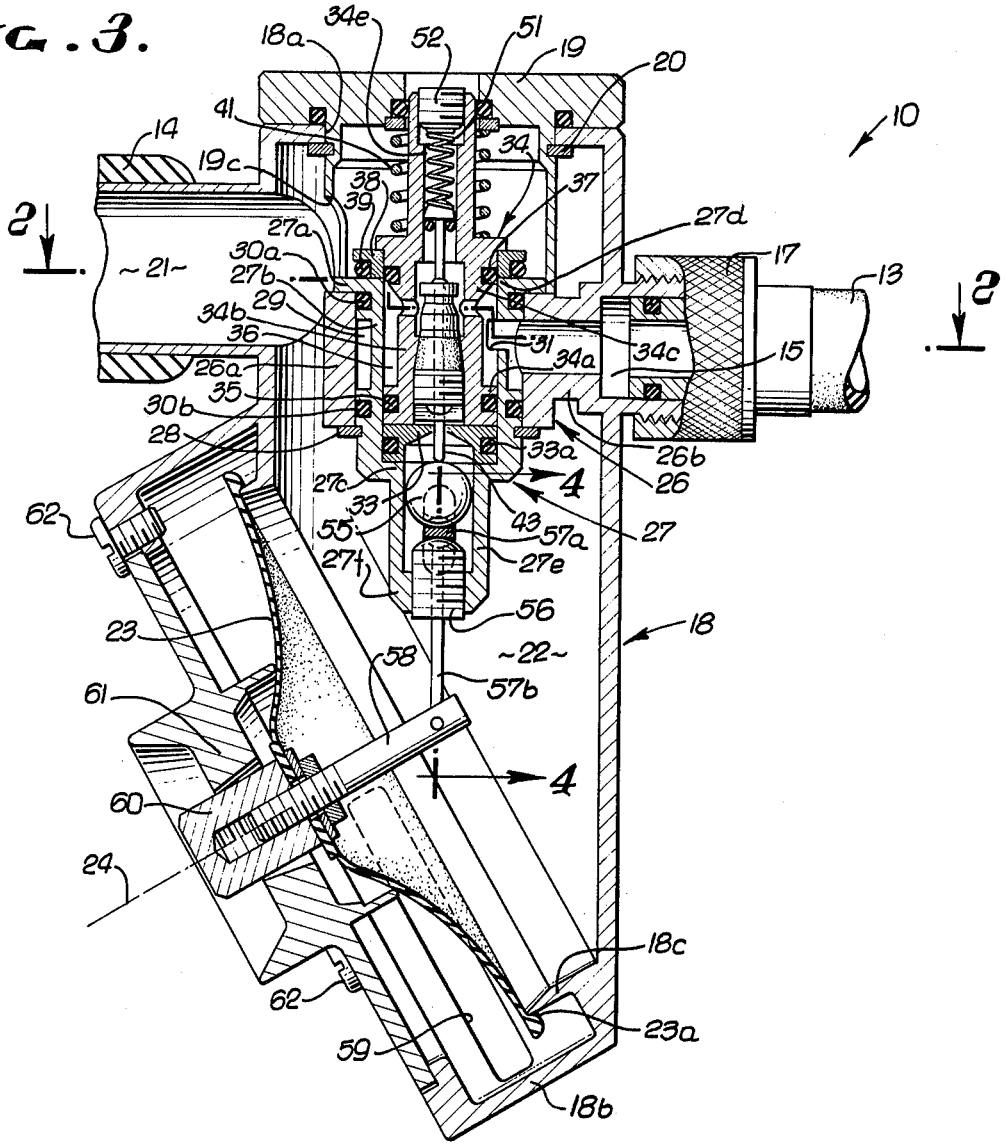
FIG. 3 is a transverse sectional view of the demand regulator as seen along the line 3—3 of FIG. 2, and shown with the flow valve closed.

Referring to FIGS. 2 and 3, the demand regulator 10 has a body 18 generally in the shape of a truncated cylinder. An opening 18*a* at the upper end of the body 18 is covered by a cap 19 that is held in place by a snap ring 20. The rubber or plastic mouthpiece 14 is attached to an outlet 21 which communicates to the interior chamber 22 of the body 18.

At the truncated lower end of the body 18 there is a generally cylindrical body portion 18*b* which encloses a diaphragm 23 that is responsive to the pressure within the interior chamber 22. When the diver inhales, the pressure in the outlet 21 and the chamber 22 is lowered, causing displacement of the diaphragm 23 along its central axis 24 in the direction of the arrow 25. As described below, this diaphragm displacement initiates a flow of breathable gas from the inlet conduit 13 to the mouthpiece outlet 21 so as to satisfy the inhalation demand.

Contained within the interior chamber 22 is a support structure 26 including a ring section 26*a* that is concentric with the body 18. This ring section 26*a* is suspended by a pair of tubular members 26*b* which project inwardly from the associated inlet ports 15, 15′.

A generally cylindrical valve housing 27 is held within the support structure 26. This mounting is accomplished by the cooperation of an annular flange 27*a* which seats on the upper end of the ring section 26*a* and by a snap ring 28 at the bottom end of the ring section 26*a*. Note that the maximum diameter of the flange 27*a* is slightly less than the diameter of the opening 18*a* so that the valve housing 27 can be inserted through this opening when the cap 19 is removed.

The cylindrical wall 27*b* of the valve housing 27 is of smaller diameter than the interior of the ring section 26*a*. Thus there is defined an annular space 29 that is in communication with the inlet port 15. A pair of O-rings 30*a*, 30*b* held by the valve housing 27 define the upper and lower limits of this annular space 29. One or more milled slots 31 through the valve housing wall 27*b* provide a flow path for incoming breathable gas into the interior of the valve housing 27.

The upper end of the valve housing 27 is open, but the lower end is substantially closed by a generally disc-shaped member 33 which seats on a shoulder 27*c*. An O-ring 33*a* prevents gas escape around the outer periphery of this member 33. Alternatively, the member 33 could be an integral part of the valve housing 27 itself.

Movably mounted within the valve housing 27 is a spindle or poppet 34. An annular flange 34*a* at the bottom of the poppet 34 has an outer diameter corresponding to the inner diameter of the valve housing cylindrical wall 27*b*. An O-ring 35 held by the flange 34 prevents air flow around this flange.

Above the flange 34*a* the poppet 34 has a region 34*b* of reduced diameter which together with the valve housing wall 27*b* defines an annular space 36. The upper end of this annular space 36 is defined by a shoulder 34*c* of the poppet 34. This shoulder 34*c* holds an O-ring 37. In the valve closed position illustrated in FIG. 3, the O-ring 37 is in contact with the corner or edge 27*d* that defines the open end of the valve housing 27. As a result, no gas can flow from the annular space 36 past the O-ring 37 and edge 27*d* to the interior chamber 22. An annular ring 38 of inverted-L-shaped cross-section retains the O-ring 37 in place and prevents the housing edge 27*d* from biting in too far into the O-ring 37. An O-ring 39 around the outer periphery of the retainer 38 prevents contaminants such as sand from reaching the O-ring 37 that serves as the flow valve member.

As described below, upon inhalation demand the poppet 34 moves upward to the position shown in FIG. 5. There the poppet shoulder 34*c* and the O-ring 37 are spaced away from the housing edge 27*d*. As a result, breathable gas from the inlet 15 can flow through the support tubular member 26*b*, the slot 31, and the annular space 36, and thence past the annular opening 40 that is formed when the poppet 34 is open. From there the breathable gas flows through the interior chamber 22 to the mouthpiece outlet 21. Normally, however, a spring 41 around the neck 34*d* of the poppet 34 biases the poppet to the closed position of FIG. 3.

Figure 6:
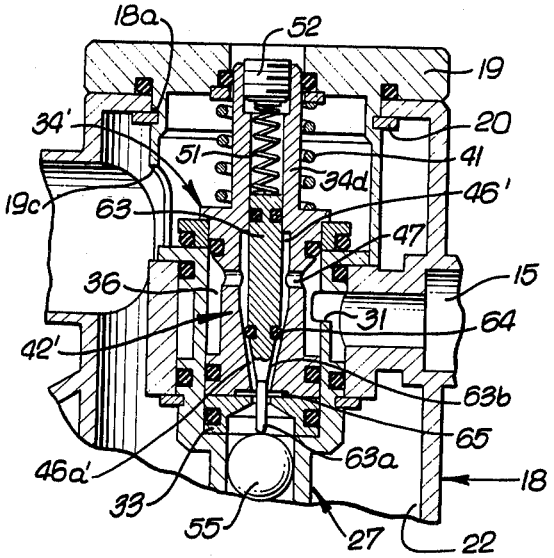
FIGS. 6 and 7 are fragmentary transverse sectional views showing alternative pilot valve configurations.
Figure 7:
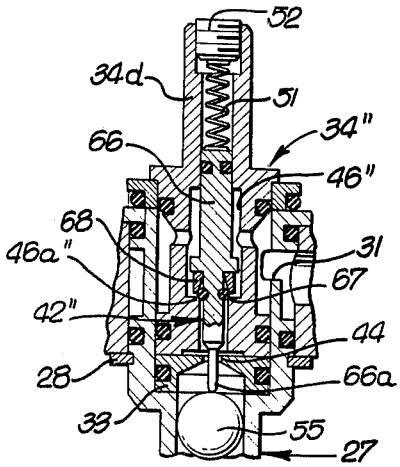

From the foregoing, it is evident that the poppet 34 and the valve housing 27 cooperate to function as a flow valve which controls the supply of breathable gas from the inlet port 15 to the mouthpiece outlet 21. Opening and closing of this flow valve in turn is controlled by a pilot valve 42 which is mounted within the poppet 34 itself. Advantageously, but not necessarily, this valve 42 comprises a conventional tire inflation valve or so-called "Schrader" valve. Alternative pilot valves are shown in FIGS. 6 and 7.

The valve 42 includes a control pin 43 which extends through a small opening 44 in the closed end of the valve housing 27. Normally the valve 42 is closed, so that the control pin 43 projects into a cylindrical extension 27*e* of the valve housing 27, as shown in FIG. 3. A linkage 45, described below, interconnects the diaphragm 23 to the pilot valve control pin 44.

The upper or inlet end 42*a* of the pilot valve 42 is situated within a chamber 46 within the poppet 34. One or more small holes or orifices 47 extend laterally through the reduced diameter region 34*b* of the poppet 34. These holes 47 provide flow communication from the annular space 36 into the chamber 46.

As a result, when the pilot valve 42 is opened, gas at the supply pressure flows from the inlet 15 via the annular space 36, the holes 47 and the chamber 46 through the pilot valve 42. As indicated by the arrows 48 in FIG. 5, this gas then flows into the space 49 between the flanged end 34*a* of the poppet 34 and the substantially closed end 33 of the valve housing 27. The gas pressure overcomes the bias of the spring 41, and hence forces open the poppet 34. Breathable gas is supplied to the mouthpiece outlet 21 as shown by the arrows 50.

An aspirator effect is achieved by providing the cap 19 with a cylindrical skirt 19*a* that extends downwardly to the support structure 26. The inner diameter of this skirt 19*a* is just slightly greater than the outer diameter of the housing upper flange 27*a*. Thus the skirt 19*a* defines a chamber 19*b* into which the breathable gas flows through the valve opening 40(FIG. 5). The skirt 19*a* has an orifice 19*c*, advantageously facing the mouthpiece outlet 21, which serves as the aspirator opening. The orientation of this orifice 19*c* can be changed by rotating the cap 19, thereby permitting the diver to adjust the aspirator effect even underwater.

The pilot valve 42 is biased closed by a spring 51 contained in a bore 34*e* through the neck 34*d* of the poppet 34. A plug 52, threaded into the end of the bore 35*e*, permits adjustment of the spring pressure that biases the valve 42 closed. An O-ring 53 prevents the escape of gas through the bore 34*e*. The pilot valve closure 42*b* may consist of a washer or like flange member mounted to the control pin 43 and cooperating with a valve seat formed at the valve upper end 42*a*.

Figure 4:
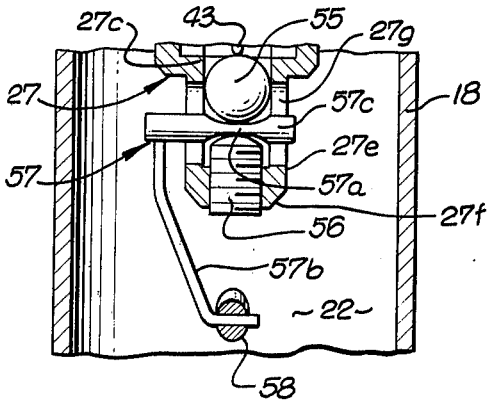
FIG. 4 is a fragmentary sectional view of the diaphragm to pilot valve linkage, as seen along the line 4—4 of FIG. 3.

The linkage 45 (FIGS. 3, 4 and 5) includes a rigid ball 55 situated within the cylrindical extension 27*e* of the valve housing 27 and having a diameter equal thereto. The ball 55 can only move axially in the extension 27*e*. An opposing member 56 is threaded to the end 27*f* of the extension 27*e* and has a spherical or other arcuate surface 56*a* facing the ball 55. Between the ball 55 and the surface 56 is a lever part 57*a* of a connector 57 having an arm 57*b* that is attached to a central shaft 58 of the diaphragm 23. The transverse cross-section of the lever part 57*a* advantageously, but not necessarily, is rectangular as shown in FIGS. 3 and 5. This lever 57*a* comprises the middle of a rod 57*c* that extends through opposed, longitudinal slots 27*g* (FIG. 4) in the cylindrical extension 27*e*.

When the diaphragm 23 is at rest (as in FIG. 3) there is point contact between the lever 57*a* and both the ball 55 and the spherical surface 56*a* along the axis of the housing extension 27*e*. The force of the spring 51, exerted via the pin 43 and the ball 55, maintains this contact. During inhalation the diaphragm 23 and its shaft 58 are displaced in the direction of the arrow 25. This causes the rod 57*c* to rotate in the slots 27*g* so that the lever 57*a* pivots about the surface 56*a* of the member 56.

Figure 5:
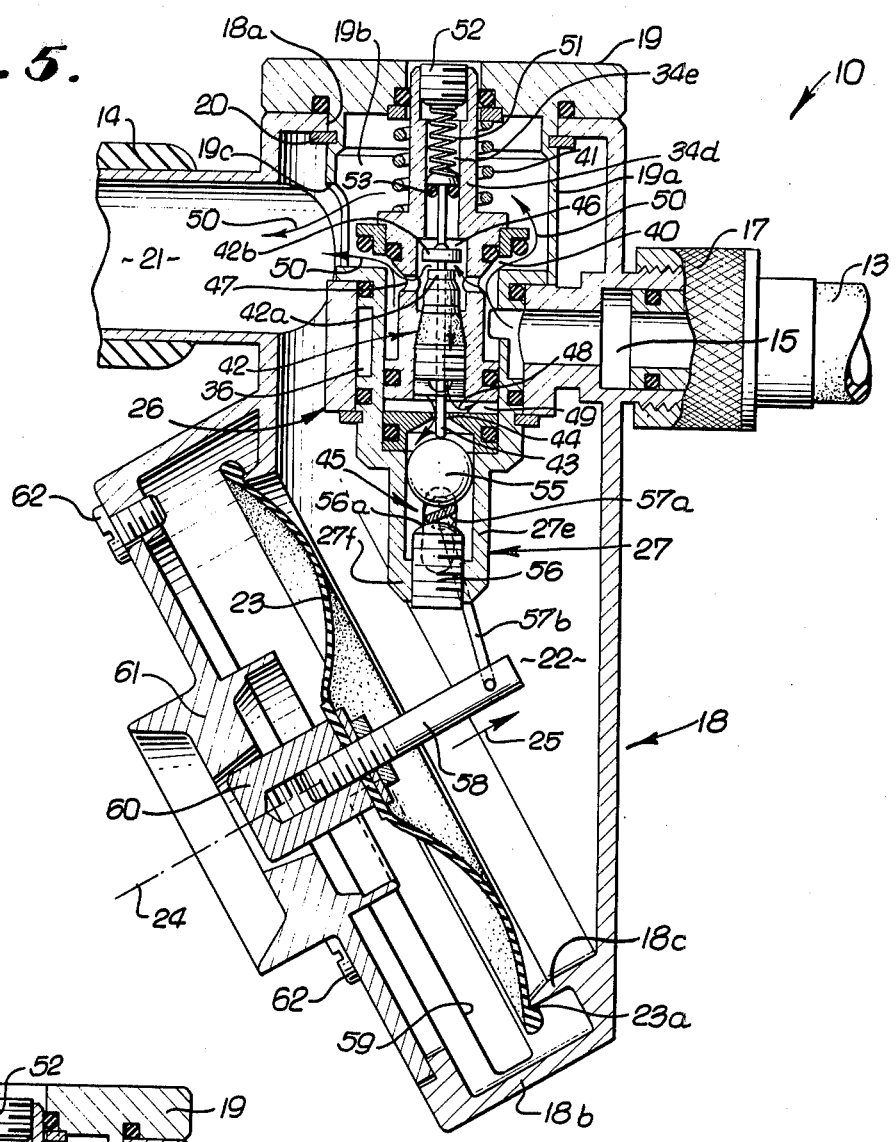
FIG. 5 is a transverse sectional view like FIG. 3, but with both the pilot valve and the flow valve open.

As shown in FIG. 5, the contact points with the lever 57*a* now are displaced away from the axis of the housing extension 27*e*. Since the member 56 is fixed, the pivotal motion of the lever 57*a* imparts an axial movement to the ball 55 in a direction away from the member 56.

This motion in turn pushes the control pin 43 upward, so as to open the pilot valve 42. For small displacement of the diaphragm 23 and concomitant small rotation of the lever 57*a* there is very slight motion imparted to the ball 55 and thence to the pilot valve control pin 43. With increasing displacement of the diaphragm 23, an equal angular pivoting of the lever 57*a* imparts a relatively larger motion to the ball 55 and hence to the control pin 43. This is beneficial since more sensitive control is achieved at the beginning and end of the inhalation cycle when the pressure differential within the chamber 22 is very slight.

At the beginning of the inhalation cycle, the very slight displacement of the diaphragm 23 is translated into a slight opening of the pilot valve 42 which in turn causes a slight opening of the flow-controlling valve poppet 34. Since the poppet 34 carries the pilot valve 42 with it, that pilot valve tends to close, thereby reducing the gas flow into the space 49 (FIG. 5) and limiting the movement of the poppet 34. If the amount of breathable gas supplied to the mouthpiece 21 does not quite satisfy the inhalation demand, the diaphragm 23 will be displaced further, so that the pilot valve 42 will open slightly more. This causes further opening of the poppet 34, supplying additional breathable gas to the diver.

As the demand is satisfied, the pressure in the interior chamber 22 increases so that the diaphragm 23 tends to return to its rest position. The spring 51 biases the pilot valve 42 toward its closed position. The control pin 43 does not have to move far, since the open poppet 34 has moved the body of the pilot valve 42 toward the closure 42*b*. When the pilot valve 42 closes, no more gas flows into the space 49. The gas already in that region vents through the opening 44, decreasing the pressure in the space 49 sufficiently so that the bias spring 41 will return the poppet 34 to its rest position (FIG. 3). Thus as the inhalation demand is satisfied, the flow valve is closed.

As a result of the cooperation of the pilot valve 42 and the poppet 43, the volume of breathable gas supplied to the diver very closely follows the inhalation demand. The pilot valve 42 in effect provides pneumatic amplification for the slight motion imparted by the diaphragm 23 and the linkage 45. Since the pilot valve 42 is carried toward a closing position as the poppet 34 opens, there also is a negative feedback effect which adds to the linearity between inhalation demand and the supply of gas to satisfy that demand. The sensitivity and response of the regulator can be controlled by choice of the diameter of the opening 44 and by adjustment of the spring 51 force using the threaded plug 52. The member 56 can be adjusted to establish the amount of diaphragm 23 displacement required to begin opening of the pilot valve 42.

In the embodiment shown, the diaphragm 23 is configured also to operate as a flap-valve facilitating the exhaust of exhaled gases. During exhalation the increased pressure in the chamber 22 forces the outer edge 23*a* of the diaphragm 23 away from the annular ring 18*c* that normally supports the diaphragm periphery. The exhaled gases are expelled around this periphery 23*a* and out through a slot 59 in the body portion 18*b*.

The diaphragm 23 itself may be secured at its center by a member 60 into which the shaft 58 is threaded. This member 60 is mounted for reciprocation in an appropriate structure 61 that is attached to the regulator body 18 by screws 62.

FIGS. 6 and 7 show alternative pilot valve structures for the inventive demand regulator. In FIG. 6, the pilot valve 42' consists of a valve shaft 63 that reciprocates in the space 46'. This space 46' is provided with a tapered lower region 46*a'* that serves as the valve seat. The valve shaft 63 includes a protruding nose 63*a* which serves as the control pin that contacts the ball 55 in the linkage 45. A tapered section 63*b* of the shaft 63 is provided with an O-ring 64 that rests on the valve seat region 46*a'* to close the pilot valve 42'. The bottom surface of the poppet 34' includes a recess 65 in communication with the lower end of the space 46'. When the pilot valve 42' is opened, breathable gas is admitted to this recess 65 to force open the poppet 34'. Such a recess also could be provided in the poppet 34 of FIGS. 3 and 5.

FIG. 7 shows a similar structure in which the pilot valve 42'' includes a valve shaft 66 that has an O-ring 67 about its lower periphery. This O-ring 67 is held in place by a retaining member 68 and functions to open and close against a valve seat 46*a''* consisting of a shoulder in the space 46''. A protruding nose 66*a* of the shaft 66 extends through the opening 44 into contact with the ball 55, so that diaphragm 23 motion will be imparted via the nose 66*a* to open the valve 42''.

In the illustrated embodiments, the poppet 34 is balanced. That is, the supplied gas in the annular space 29 exerts a force equally in opposite directions against the lower flange 34*a* and the upper shoulder 34*c*. However, this is not necessary, and an unbalanced arrangement could be employed, to bias the poppet closed. This could eliminate the need for the bias spring 41. Similarly, the pilot valve shaft 63, 66 of FIGS. 6 or 7 could be unbalanced to eliminate or reduce the bias requirements of the spring 51.

Figure 8:
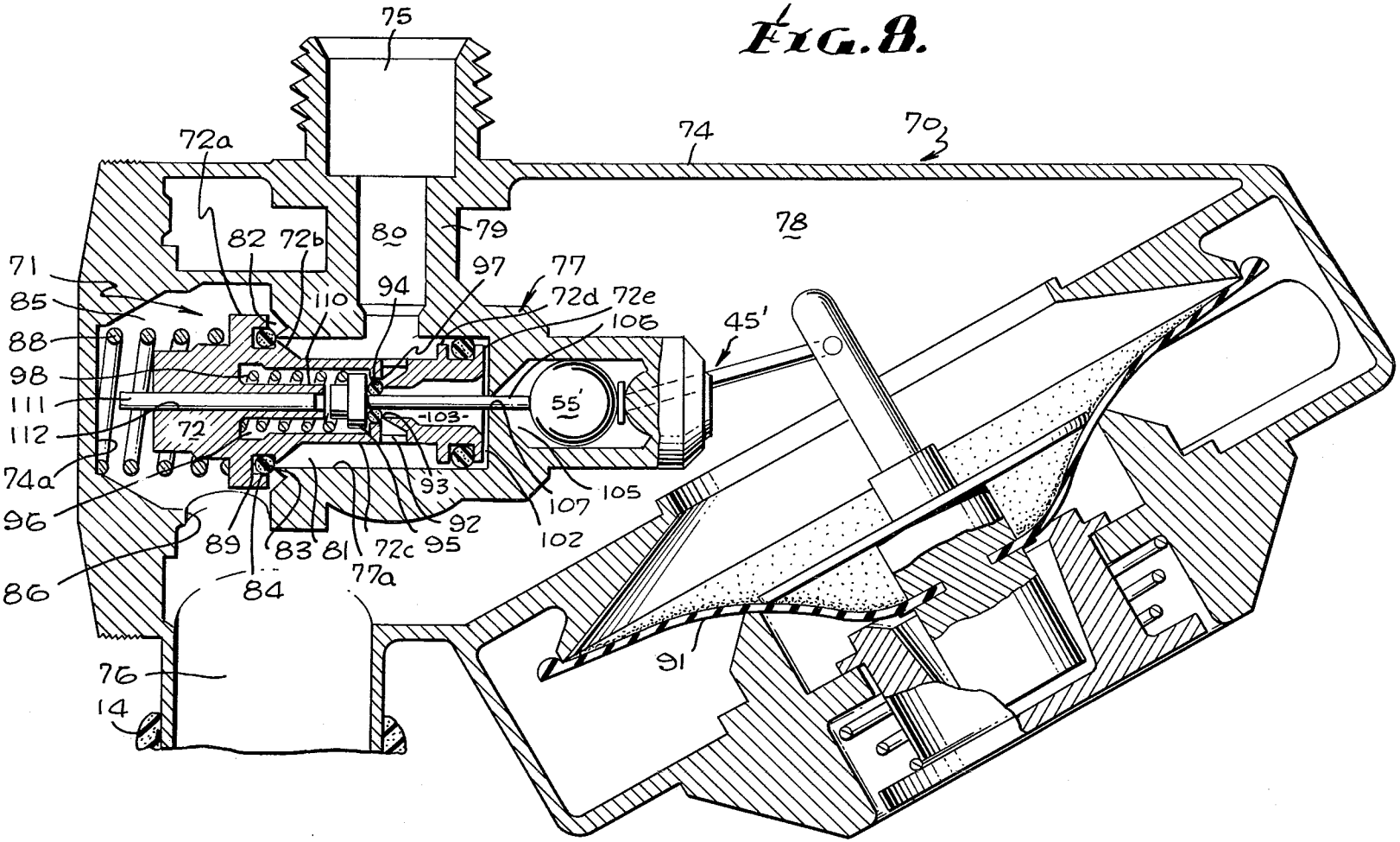
FIG. 8 is a transverse sectional view of another, preferred embodiment of the invention, with the main flow valve and the pilot valve both shown in the flow-blocking position.
Figure 9:
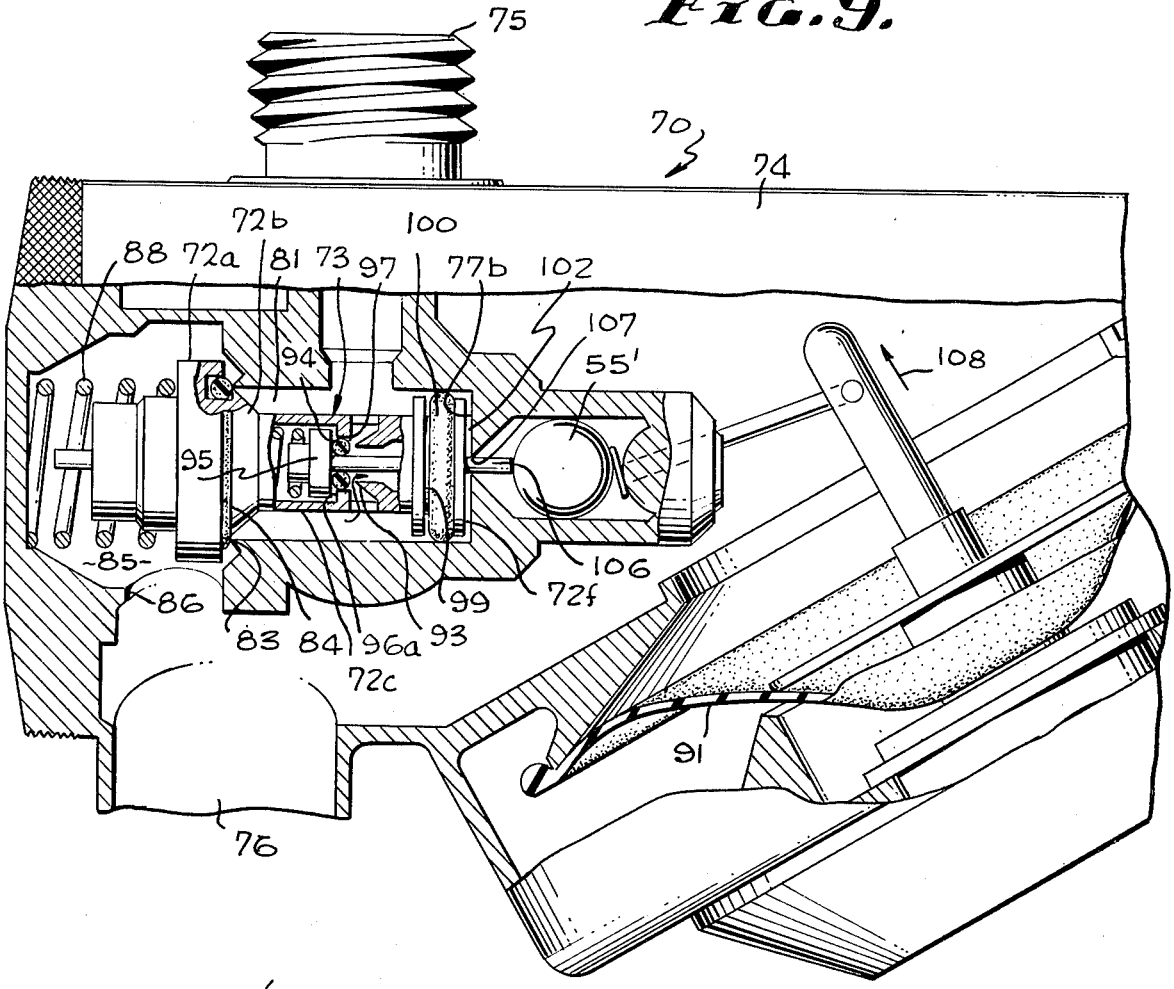
FIG. 9 is a side view, partly broken away and in section, of the regulator second stage of FIG. 8, showing the pilot valve open and the main flow valve closed.
Figure 10:
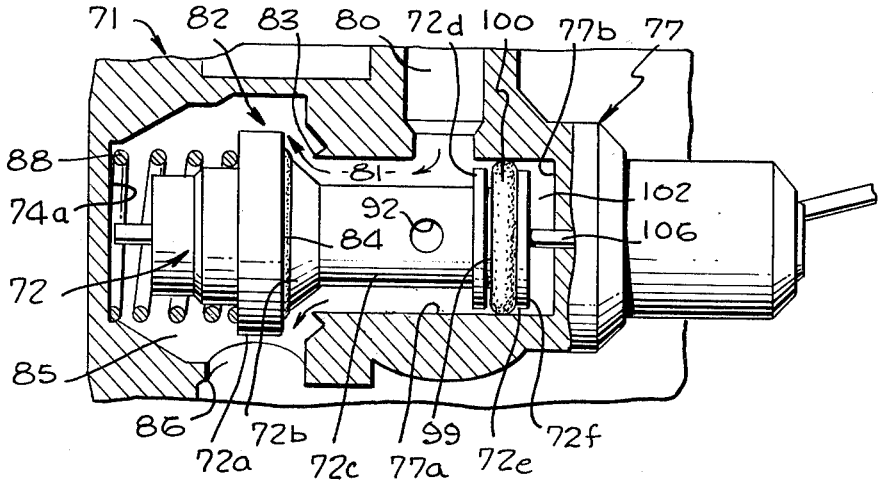
FIG. 10 is a fragmentary sectional view of the valve assembly of the FIG. 8 embodiment with the main flow valve open.

In the preferred embodiment of FIGS. 8, 9 and 10, the scuba regulator 70 also employs pneumatic amplification and feedback to achieve low inhalation effort and close relationship between demand and supply of breathable gas. Like the above described embodiments, the regulator 70 has a valve assembly 71 including a unitary valve poppet 72 that controls gas flow to the diver and that carries the pilot valve 73 in a manner which provides both pneumatic amplification and feedback.

The regulator body 74 generally is configured like the body 18 and includes one or two inlet ports 75 and an outlet port 76 which receives the mouthpiece 14. The valve poppet 72 is situated within a generally cylindrical valve housing 77 mounted within the interior chamber 78 of the body 74. A tubular member 79 helps support the valve housing 77 and provides flow communication from the inlet port 75 via a channel 80 to a generally annular inlet chamber 81 within the housing 77.

Air flow from the chamber 81 to the diver is controlled by a main valve 82 consisting of an annular valve seat 83 formed in the housing 77 and a valve closure consisting of an O-ring 84 retained in a shoulder of valve poppet 72. The valve poppet 72 is axially moveable within the housing 77. When it is moved away from the valve seat 83 as shown in FIG. 10, breathable gas is supplied from the inlet port 74 via the channel 80, the chamber 81, the annular space between the valve seat 83 and the valve closure ring 84, an annular chamber 85 surrounding an end of the poppet 72, an aspirator opening 86 and the outlet port 76.

Normally the main valve 82 is held closed (FIG. 8) by a bias spring 88 situated in the chamber 85 between a closed end 74*a* of the body 74 and an annular shoulder section 72*a* of the valve poppet 72. The spring force biases the O-ring 84 into flow-blocking contact with the valve seat 83. The O-ring 84 itself is situated in a groove 89 formed in the shoulder section 72*a* and retained therein by an annular tapered flange section 72*b*. Only a portion, typically about 90°, of the O-ring 84 is exposed. The valve seat 83 is of generally pointed cross-section, and comes to an apex at about the center of the exposed portion of the O-ring 84.

Movement of the valve poppet 72 is controlled by the pilot valve 73 which itself is linked to a diaphragm 91 that senses pressure in the chamber 78. The pilot valve 73 is situated within a reduced diameter valve poppet section 72*c* (FIG. 10) that defines the inner wall of the inlet chamber 81. One or more lateral ports 92 extend from the chamber 81 through the poppet section 72*c*. These ports lead to an annular space within the poppet section 72*c* containing an annular tapered valve seat 93 for the pilot valve 73.

Cooperating with the valve seat 93 is an O-ring 94 that serves as the valve closure. Behind the O-ring 94 is a generally disc-shaped backup member 95 that can move axially within a chamber 96 formed within the valve poppet 72. One end 96*a* of the chamber 96 includes a central aperture 97 within which the O-ring 94 is situated. This aperture 97 opens into the lateral ports 92 so that a portion of the O-ring 94 is exposed to the high gas pressure from the inlet chamber 81. However, in the rest position of FIG. 8, the O-ring 94 is biased into flow-blocking contact with the valve seat 93 by a spring 98 situated within the chamber 96.

The outer wall of the inlet chamber 81 is defined by a cylindrical bore 77*a* within the valve housing 77 having a closed end 77*b*. Adjacent this closed end, the valve poppet 72 has a pair of axially spaced, enlarged diameter flanges 72*d*, 72*e* that form a channel 99 to retain an O-ring 100. This O-ring 100 is in sealing contact with the bore 77*a* so as to prevent the flow of gas from the inlet chamber 81 to the space 102 between the end 72*f* of the valve poppet 72 and the closed end 77*b* of the bore 77*a*.

An axial bore 103 extends into the valve poppet 72 from the end 72*f* thereof and communicates with the interior of the pilot valve seat 93. When the pilot valve 73 is open, as shown in FIG. 9, gas at the supply pressure flows through the ports 92, past the space between the valve seat 93 and the O-ring 94, through the bore 103 into the space 102. The resultant gas pressure exerted on the poppet end 72*f* causes the valve poppet 72 to move toward the flow-open position, shown in FIG. 10, in which breathable gas is supplied to the diver.

The pilot valve 73 is opened in response to inhalation demand as sensed by the diaphragm 91. Movement of the diaphragm 91 is transmitted to the valve 73 by means of a linkage 45', similar to the linkage 45 described above, that imparts axial movement to a ball 55' that is constrained within a chamber 105 in the housing 77 on the other side of the bore end 77*b*. An axial pin 106 extends between the ball 55' and the O-ring backup disc 95. This pin 106 passes through a slight clearance opening 107 in the wall between the chamber 105 and the bore end 77*b*, through the bore 103, through the center of the O-ring 94, and abuts against the end of the backup disc 95. Preferably the outer diameter of the pin 106 is the same as, or even slightly greater than the inner diameter of the O-ring 94, so as to insure seating of the O-ring 94 against the opening 97.

As the diver inhales, the pressure in the chamber 78 is reduced, causing slight movement of the diaphragm 91 in the direction of the arrow 108 (FIG. 9). This imparts axial movement to the pin 106 via the linkage 45' and the ball 55' in a direction that pushes the O-ring backup disc 95 away from the pilot valve seat 93. The pressure of the gas in the inlet chamber 81 then urges the O-ring 94 away from the seat 93, so that gas can flow through the bore 103 into the space 102. As a result, the valve poppet 72 moves away from the bore end 77*b* into the flow-permitting position of FIG. 10.

Pneumatic amplification thus is achieved. The diaphragm and linkage do not open the main valve 82 directly, as in regulators without pneumatic amplification. Rather, the diaphragm operates only the pilot valve 73, which requires far less force to operate than does the main valve 82. When the pilot valve 73 is opened, the supply gas is admitted into the sapce 102 where the gas itself provides the force necessary to open the main valve poppet 72.

As the main valve poppet 72 begins to move toward the open position (FIG. 10), it carries the backup disc 95 and the O-ring 94 in a direction away from the ball 55', so that the pin 106 no longer is abutting against the disc 95. The spring 98 then urges the disc 95 and O-ring 94 toward the valve seat 93 so that the pilot valve tends to close. This in turn limits the extent to which the main valve poppet 72 is urged open. If the inhalation demand is satisfied, the pilot valve closes, the gas in the space 102 bleeds through the opening, and the bias spring 88 returns the main valve poppet 72 toward the closed position of FIG. 9. In this manner, a feedback effect is achieved such that a very close relationship exists between inhalation demand and the amount of breathable gas supplied by the valve assembly 71.

As a safety feature, a boss 110 is provided within the chamber 96 to limit the extent of travel of the O-ring backup disc 95. A pin 111 is situated in a bore 112 that extends from the chamber 96 through the boss 110 to the chamber 85. Should the pilot valve 73 malfunction and remain open so that the main valve poppet 72 is urged toward an extreme open position, one end of the pin 111 will abut against the inner end wall 74*a* of the body 74. Continued movement of the valve poppet 72 will cause the other end of the now stationary pin 111 to push the backup disc 95 and O-ring 94 into closed relationship with the valve seat 93, thereby closing the pilot valve. As a result, the gas in the space 102 will bleed off through the opening 107 and the bias spring 88 will close the main valve poppet 72.

Intending to claim all novel, useful and unobivious features shown or described, I make the following claims:

1. A demand regulator for use with a breathing apparatus comprising:

a regulator body having an interior chamber, a mouthpiece outlet communicating from said interior chamber, a diaphragm responsive to pressure within said interior chamber, an inlet port, an annular support member within said interior chamber, and a tublar member communicating between said inlet port and said support member, a generally cylindrical valve housing removably supported within said annular support member, said housing having an open end and a substantially closed end, a poppet movably mounted within said valve housing, said inlet port communicating via said tubular member and an inlet opening in said valve housing to a space between said valve housing and said poppet, the flow of breathable gas from said inlet port to said interior chamber being controlled by a flow valve formed by said poppet and a portion of said housing, said poppet being biased to a position closing said flow valve, and a normally closed pilot valve mounted within said poppet for movement therewith, and controlling the flow of gas from said space via a flow channel through said poppet to a position between an end of said poppet and said substantially closed end of said housing, the force of said gas admitted to said position being exerted directly on said poppet end to cause displacement of said poppet against said bias, thereby opening said flow valve, said pilot valve being linked to said diaphragm and being mounted so that said pilot valve is urged closed as said poppet is displaced in the flow valve opening direction.

2. A demand regulator according to claim 1 wherein;

said valve housing and said poppet each are generally cylindrical, said poppet has a central annular region of reduced diameter, said space being annular and defined by said poppet central region and the interior wall of said valve housing, there being a passageway for breathable gas from said inlet into said annular space, and wherein said flow valve is defined by an annular edge of said valve housing at said open end in cooperation with a sealing member mounted on a shoulder of said poppet.

3. A demand regulator according to claim 2 wherein said pilot valve is situated in said flow channel which extends through said poppet from said space to said position between said poppet end and said housing closed end, said pilot valve comprising;

a control member extending through a small relief opening in said housing substantially closed end, said diaphragm being operatively connected to said control member by a linkage, a valve seat and a valve closure member situated within said poppet and cooperating to control the flow of gas through said flow channel, said control member being mounted to urge said valve closure away from said valve seat in response to diaphragm displacement, and a bias spring situated completely within said poppet urging said valve closure toward said valve seat, so that as said poppet moves toward said flow valve opening position said valve closure member and said valve seat are carried in a direction away from said control member and linkage, whereby said bias spring urges said pilot valve closed.

4. A demand regulator according to claim 3 wherein said flow channel comprises an axial bore extending partway through said poppet from said poppet end, and at least one lateral port extending from said axial bore to the exterior of said poppet central region, wherein a valve seat is situated within said flow channel, wherein said valve closure member is situated in a chamber interior of said poppet and communicating to said axial bore, said closure member comprising a sealing ring and a rigid backup disc therefor, said bias spring being situated within said poppet chamber and cooperating with said backup disc so as to urge said sealing ring into flow-blocking contact with said valve seat, said control member comprising a pin extending coaxially through said small opening, through said axial bore and through the center of said sealing ring and abutting against said backup disc.

5. A pneumatically assisted demand valve for a scuba regulator second stage, said second stage having a body including an inlet port to which breathable gas is supplied from the regulator first stage, and a valve support structure within said body including a support ring and a tubular member ridigly connecting said ring to said body, said valve comprising:

a flow control valve having a relatively stationary housing that is removably mounted within said support ring, said housing having an inlet chamber therein to which breathable gas is supplied via said inlet port and said tubular member, said inlet chamber having an open end forming a valve seat and a closed end, said flow control valve also having a relatively movable poppet situated for reciprocation within said inlet chamber and having a portion that cooperates with said valve seat to block or open a flow path for breathable gas from the regulator first stage past the inlet chamber open end to the mouthpiece, said poppet being biased toward the flow blocking position in which said portion closes said inlet chamber open end, said poppet having sealing means for preventing the flow of breathable gas from said regulator first stage to a space between said poppet and the closed end of said inlet chamber, and a pilot valve mounted within and carried by said poppet for controllably admitting input breathable gas through a channel within said poppet to said space between said poppet and said inlet chamber closed end so that the pressure of said admitted gas urges movement of said poppet against said bias toward the open flow position, said pilot valve comprising;

a pilot valve seat formed as an integral part of said poppet, a closure within said poppet, and bias means comprising a spring carried completely within said poppet for biasing said closure against said pilot valve seat so as to block the flow of input breathable gas into said space via said channel, said closure being opened by movement away from said pilot valve seat in a direction the same as opening movement of said poppet, said spring urging said closure back toward said pilot valve seat during opening movement of said poppet.

6. A demand valve according to claim 5 wherein said regulator second stage has a mouthpiece and a pressure sensing diaphragm, said valve further comprising a control pin extending from said closure through said channel and projecting externally of said valve through a hole in said inlet chamber closed end, there being a linkage connecting said diaphragm to said control pin to cause movement thereof in the direction urging said closure away from said valve seat when inhalation through said mouthpiece is sensed by said diaphragm, the resultant flow-opening movement of said poppet in the same direction causing said pilot valve to be carried away from said linkage, so that said bias means urges said closure back toward said pilot valve seat, thereby implementing negative feedback in the demand valve operation.

7. A demand valve according to claim 5 wherein said housing includes an inlet opening aligned with said tubular member to provide an input flow path for breathable gas from said first stage via said inlet port, said tubular member and said aligned inlet opening into said inlet chamber, and further including a second spring mounted between said poppet and said body to bias said poppet toward said flow blocking position.

8. A demand valve according to claim 7 wherein said body has a removable end cap, said valve housing, poppet and pilot valve being insertable as a unitary assembly through the end of said body and into said support ring when said end cap is removed, said second spring being mounted between said poppet and said end cap, there being a skirt extending from said end cap to cover the portion of said poppet extending from said housing to form an outlet chamber for breathable gas from said flow control valve, said skirt having an aspirator opening through which said breathable gas flows to said mouthpiece.

* * * * *